US009331440B2

(12) United States Patent
Yoshida et al.

(10) Patent No.: US 9,331,440 B2
(45) Date of Patent: May 3, 2016

(54) CONNECTOR

(71) Applicant: Sumitomo Wiring Systems, Ltd., Yokkaichi, Mie (JP)

(72) Inventors: Keiichi Yoshida, Yokkaichi (JP); Hiroyuki Matsuoka, Yokkaichi (JP); Takuya Tate, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/525,258

(22) Filed: Oct. 28, 2014

(65) Prior Publication Data

US 2015/0132996 A1 May 14, 2015

(30) Foreign Application Priority Data

Nov. 12, 2013 (JP) ..... 2013-233907

(51) Int. Cl.

| | |
|---|---|
| ***H01R 13/648*** | (2006.01) |
| ***H01R 24/60*** | (2011.01) |
| ***H01R 13/504*** | (2006.01) |
| *H01R 4/34* | (2006.01) |
| *H01R 13/207* | (2006.01) |
| *H01R 13/52* | (2006.01) |

(52) U.S. Cl.

CPC ..... *H01R 24/60* (2013.01); *H01R 13/504* (2013.01); *H01R 4/34* (2013.01); *H01R 13/207* (2013.01); *H01R 13/5219* (2013.01)

(58) Field of Classification Search

CPC ..... H01R 13/65802; H01R 33/88
USPC ..... 439/607.01, 610, 483–484
See application file for complete search history.

(56) References Cited

U.S. PATENT DOCUMENTS

| | | | | |
|---|---|---|---|---|
| 5,735,702 | A | 4/1998 | Hio | |
| 2003/0139082 | A1 * | 7/2003 | Aramoto | H01R 13/6273 439/358 |
| 2005/0191904 | A1 * | 9/2005 | Fukushima | H01R 13/6589 439/607.58 |

* cited by examiner

*Primary Examiner* — Phuongchi T Nguyen
(74) *Attorney, Agent, or Firm* — Gerald E. Hespos; Michael J. Porco; Matthew T. Hespos

(57) ABSTRACT

A connector (10) includes a first housing (12) made of synthetic resin and including a fitting (11), and a second housing (14) made of synthetic resin and including a tubular receptacle (13) into which the fitting (11) is to be fit. At least one first projection (37) projects forward on a front end part (40) of the fitting (11) in the connecting direction and at least one second projection (43) projecting toward the first projection (37) is formed on a part of a back wall (27) of the receptacle (13) corresponding to the first projection (37). A fitting depth of the first and second housings (12, 14) is specified by the contact of a tip (38) of the first projection (37) and a tip (44) of the second projection (43) when the first and second housings (12, 14) are connected properly.

6 Claims, 9 Drawing Sheets

CONNECTOR

BACKGROUND

1. Field of the Invention

The present invention relates to a connector.

2. Description of the Related Art

U.S. Pat. No. 5,735,702 discloses a connector with first and second housings made of synthetic resin. The second housing includes a tubular receptacle into which the first housing is to be fit. A front end part of the first housing in a connecting direction is in contact with a back wall of a receptacle of the second housing when the first and second housings are connected properly. In this way, a fitting depth of the first and second housings is specified.

According to the above configuration, it is necessary to manage both the shape of the front end part of the first housing and that of the back wall of the receptacle of the second housing to manage the fitting depth of the first and second housings. However, the synthetic resin of the front end part of the first housing or the back wall of the receptacle of the second housing may be distorted or deflected due to sinks and the like after injection molding. It is not easy to manage both the shapes of the front end part of the first housing and the back wall of the receptacle of the second housing while suppressing distortion and deflection.

The invention was completed based on the above situation and aims to provide a connector capable of easily managing a fitting depth.

SUMMARY OF THE INVENTION

The invention is directed to a connector with first and second housings made of synthetic resin. The first housing includes a fitting and the second housing includes a tubular receptacle that receives the fitting. At least one first projection projects forward from a front end part of the fitting in the connecting direction and at least one second projection is formed on a part of a back wall of the receptacle corresponding to the first projection and projects toward the first projection. A fitting depth of the first and second housings is specified by contact of tip parts of the first and second projections in a state where the first and second housings are connected properly. Thus, the fitting depth of the first and second housings can be managed merely by managing the shapes of the tip parts of the first and second projections. The areas of the tip parts of the first and second projections are smaller than areas of the front end of the fitting and the back wall of the receptacle. Hence, the shapes of the first and second projections and the fitting depth of the first and second housings can be managed easily.

The receptacle and the fitting may be long and narrow in a major axis direction perpendicular to the connecting direction. The fitting also may be long and narrow in the major axis direction. Suppressing distortion of the front end of the fitting and the back wall of the receptacle is more difficult when the receptacle and the fitting are long and narrow in the major axis direction. Managing the fitting depth of the first and second housings in the connector is managed easily with a receptacle and a fitting that are long and narrow in the major axis direction, as explained herein.

The first projections may include first major axis projections at positions of the front end part of the fitting near opposite ends in the major axis direction, and the second projections may include second major axis projections at positions of the back wall of the receptacle near opposite ends in the major axis direction. The opposite ends having a largest width are assumed to have a largest tolerance. Thus, the fitting depth of the first and second housings can be managed accurately by forming the first and second major axis projections on these ends having a largest width.

The first projections may include first minor axis projections at positions of the front end part of the fitting near opposite ends in a minor axis direction perpendicular to both the connecting direction and the major axis direction, and the second projections may include second minor axis projections at positions of the back wall of the receptacle near opposite ends in the minor axis direction perpendicular to both the connecting direction and the major axis direction. Accordingly, the fitting depth of the first and second housings also can be managed in the minor axis direction so that the fitting depth of the first and second housings can be managed more accurately as a whole.

Three or more first projections and three or more second projections may be formed. Thus, a first virtual plane is defined by tips of the first projections, and a second virtual plane is defined by tips of the second projections. The fitting depth of the first and second housings can be managed precisely by managing the shape of the tips of the first and second projections so that the first and second planes are aligned.

The first housing may include a first terminal with a plate-like first connecting portion and the second housing may include a second terminal with a plate-like second connecting portion. The first and second terminals are connected electrically by placing the first and second connecting portions one over the other and penetrating a bolt through the first and second connecting portions. The fitting depth of the first and second housings is specified so that the first and second connecting portions are separated slightly when the first and second housings are connected properly. It may not be possible to manage a fitting depth of the connector precisely if the terminals come into contact before the housings reach a properly connected state. Further, the terminals may be damaged by their mutual contact and electrical connection reliability may be reduced. However, the first and second connecting portions are separated slightly when the first and second housings are connected properly. In this way, it is possible to manage the fitting depth of the first and second housings and reliably electrically connect the first and second terminals. Further, damage caused by mutual contact of the first and second connecting portions when connecting the first and second housings can be suppressed. Therefore, electrical connection reliability of the first and second terminals can be improved.

DETAILED DESCRIPTION

Figure 1:
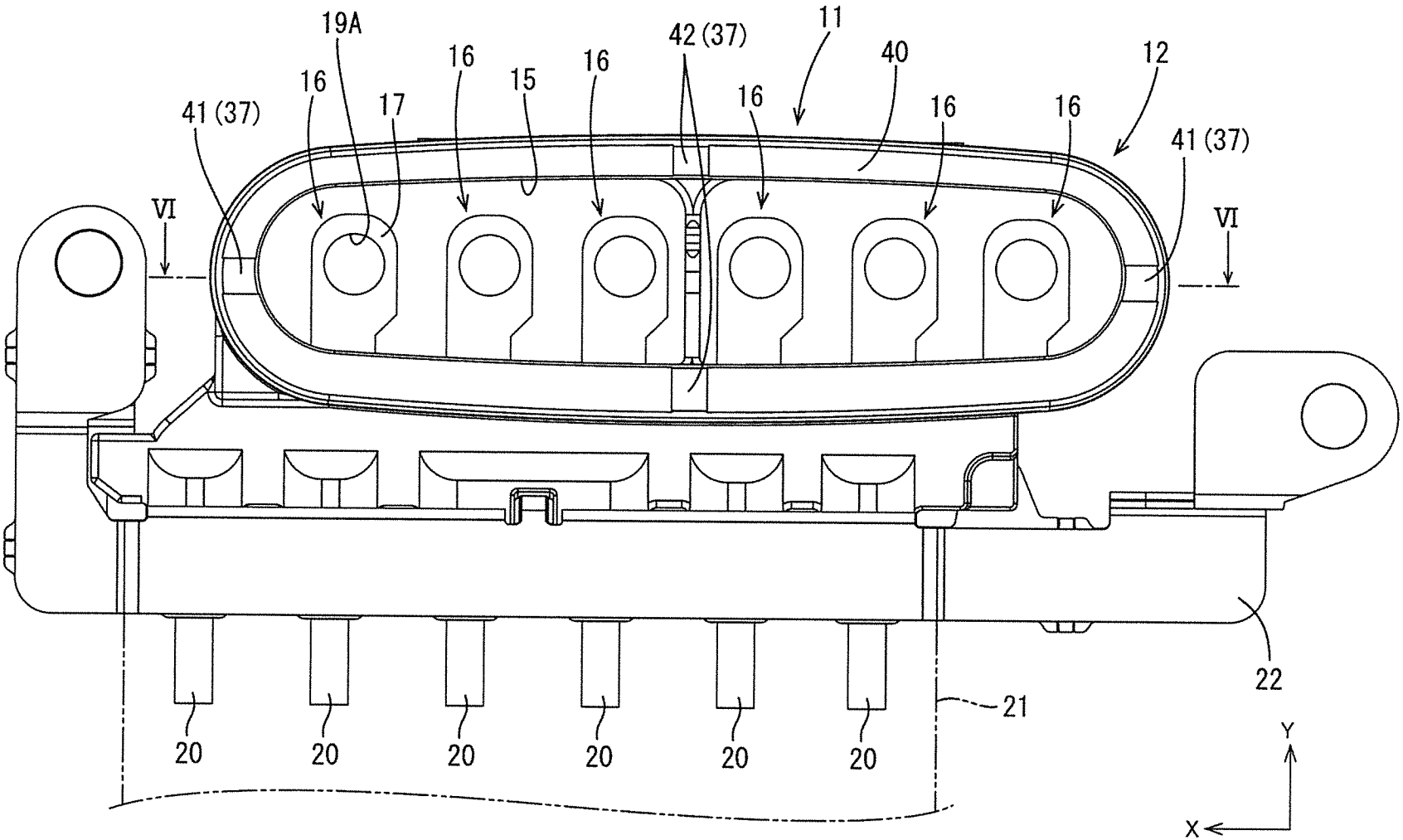
FIG. 1 is a bottom view showing a first housing according to one embodiment of the present invention.

A connector according to a first embodiment of the invention is identified by the numeral 10 in FIGS. 1 to 7. The connector 10 has first and second housings 12 and 14 made of synthetic resin. The first housing 12 includes a fitting 11 and the second housing 14 includes a tubular receptacle 13 into which the fitting 11 can be fit. In the following description, a connecting direction of the first and second housings 12, 14 is referred to as a Z direction, a major axis direction to be described later is referred to as an X-axis direction and a minor axis direction to be described later is referred to as a Y-axis direction as shown in the drawings. The connecting direction, the major axis direction and the minor axis direction are perpendicular to each other. Further, for a plural members having the same shape, one member may be denoted by a reference sign and the other member(s) may not be denoted in the drawings.

As shown in FIG. 1, the fitting 11 is long and narrow in the major axis direction. In this embodiment, the fitting 11 has a substantially oval shape when viewed in the connecting direction (direction penetrating through the plane of FIG. 1).

Figure 2:
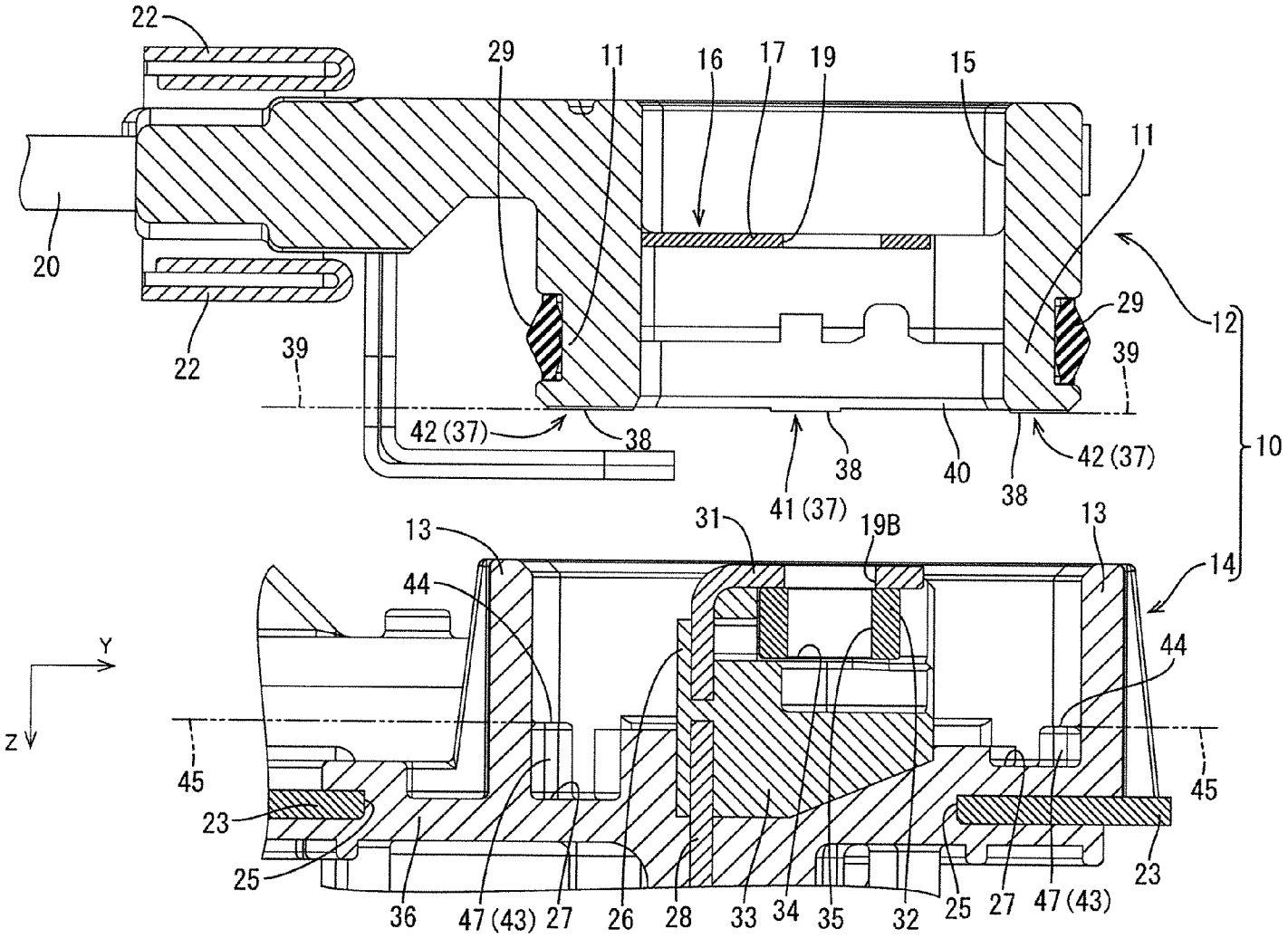
FIG. 2 is a section showing the first housing and a second housing.

As shown in FIG. 2, a work hole 15 penetrates through the fitting 11 in the connecting direction. As shown in FIG. 1, first terminals 16 are arranged in the work hole 15 and may be formed from metal, such as copper, copper alloy, aluminum, aluminum alloy, iron or stainless steel. A plating layer (not shown) made of metal such as tin or nickel may be formed on a surface of the first terminal 16.

The first terminals 16 are arranged side by side in the major axis direction. The first terminal 16 includes a plate-like first connecting portion 17. A bolt insertion hole 19A penetrates through the first connecting portion 17 in the connecting direction and can receive a bolt 18. The first terminals 16 are connected respectively to ends of wires 20 by a known technique, such as crimping. The wires 20 are drawn out from the first housing 12 while being arranged side by side in the major axis direction.

The wires 20 are collectively surrounded by a tubular braided wire 21 for electromagnetic shielding. The braided wire 21 is held tightly onto the first housing 12 by a pair of caulking members 22 made of metal.

The wires 20 and the first terminals 16 are formed integrally to the first housing 12 by insert molding with synthetic resin.

The caulking members 22 are formed by press-working a metal plate material into a predetermined shape. A metal, such as copper, copper alloy, aluminum, aluminum alloy, iron or stainless steel can be appropriately selected as a metal for the caulking member 22. A plating layer (not shown) made of metal, such as tin or nickel, may be formed on a surface of the caulking member 22.

The second housing 14 is mounted on a device (not shown), such as a motor or an inverter, installed in a vehicle (not shown), such as an electric vehicle or a hybrid vehicle.

Figure 3:
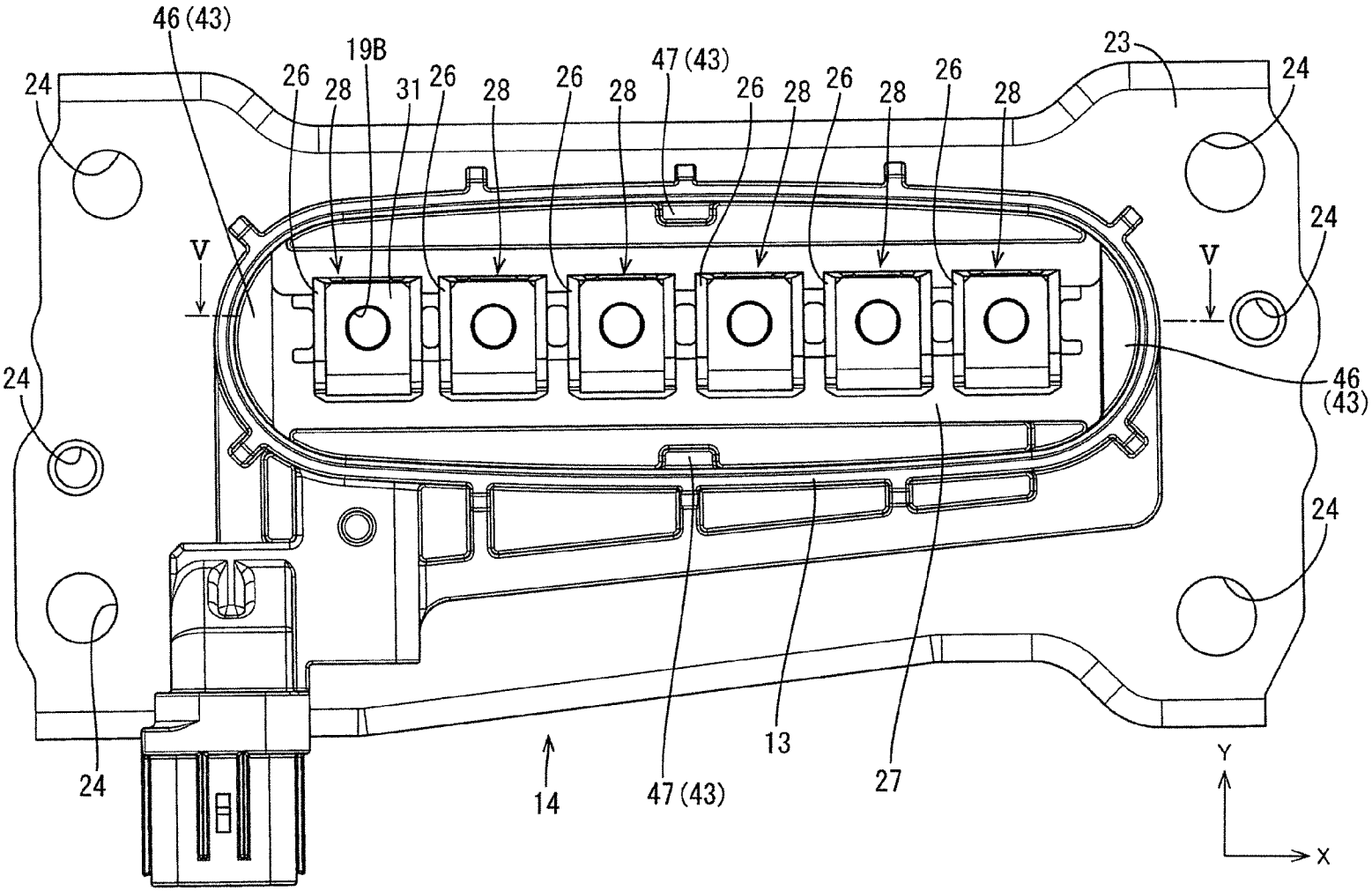
FIG. 3 is a plan view showing the second housing.

As shown in FIG. 3, the second housing 14 is insert-molded with a plate 23 made of metal. A metal, such as aluminum, aluminum alloy, copper, copper alloy, iron or stainless steel, can be selected as a metal constituting the plate 23. The plate 23 is formed with mounting holes 24 through which bolts (not shown) for fixing the plate 23 to the device are inserted. As shown in FIG. 2, an opening 25 penetrates the plate 23 in a plate thickness direction.

As shown in FIG. 2, the second housing 14 is formed integrally to the plate 23 in an arrangement to penetrate through the opening 25 on the plate 23 in the connecting direction.

The second housing 14 includes the receptacle 13 which projects in the connecting direction and into which the fitting 11 of the first housing 12 is to be fit. As shown in FIG. 3, the receptacle 13 is long and narrow in the major axis direction and has a substantially oval shape when viewed in the connecting direction (direction penetrating through the plane of FIG. 3). Terminal blocks 26 project from a back wall 27 of the receptacle 13 and are substantially in the form of rectangular columns. A second terminal 28 is arranged on each terminal block 26.

Figure 4:
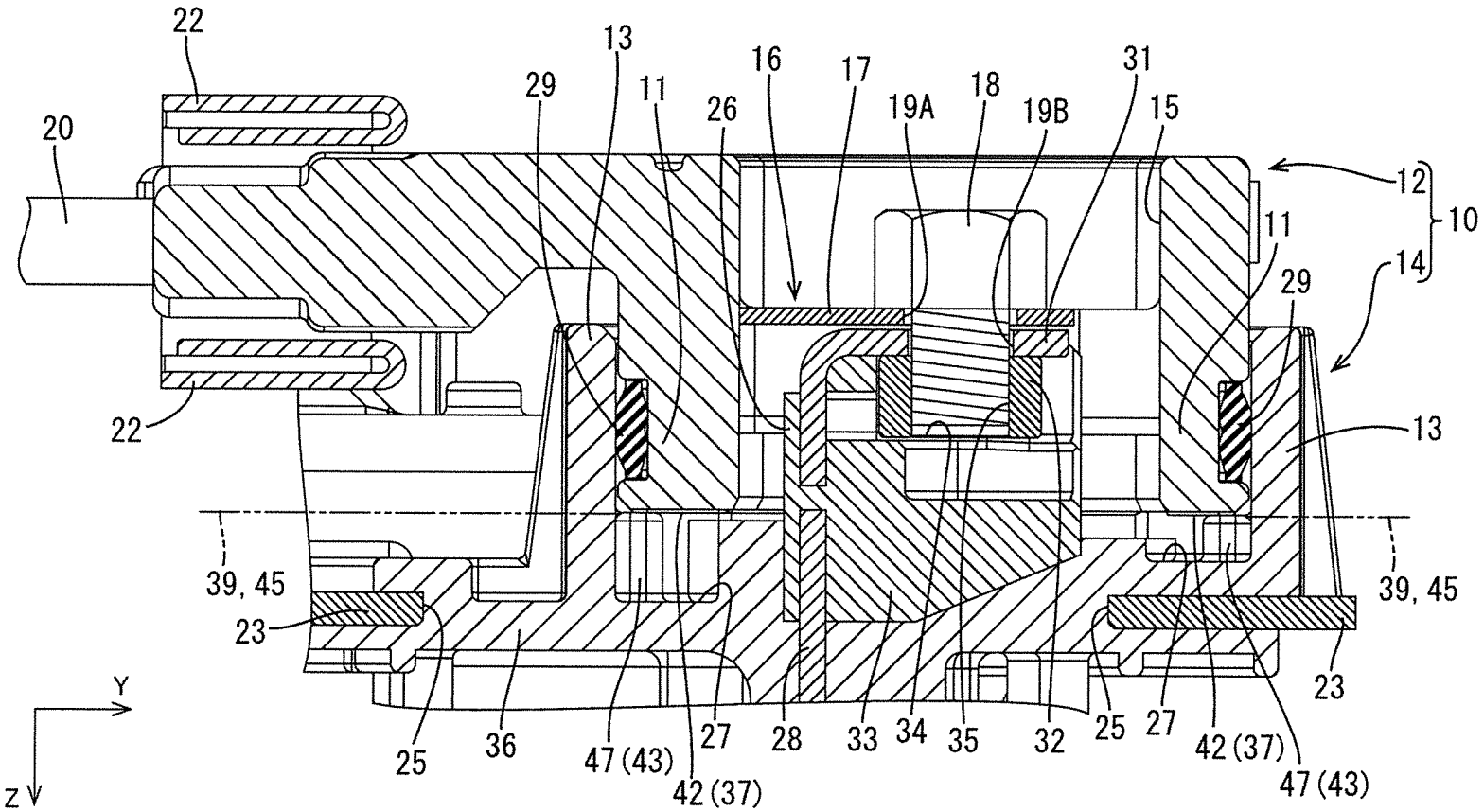
FIG. 4 is a section showing a state where the first and second housings are connected.

As shown in FIG. 4, a seal ring 29 to be held in close contact with the inner wall surface of the receptacle 13 is fit externally on the outer surface of the receptacle 13 when the fitting 11 is fit in the receptacle 13. The close contact of the seal ring 29 and the inner wall surface of the receptacle 13 seals between the receptacle 13 and the fitting 11 in a liquid-tight manner.

Figure 5:
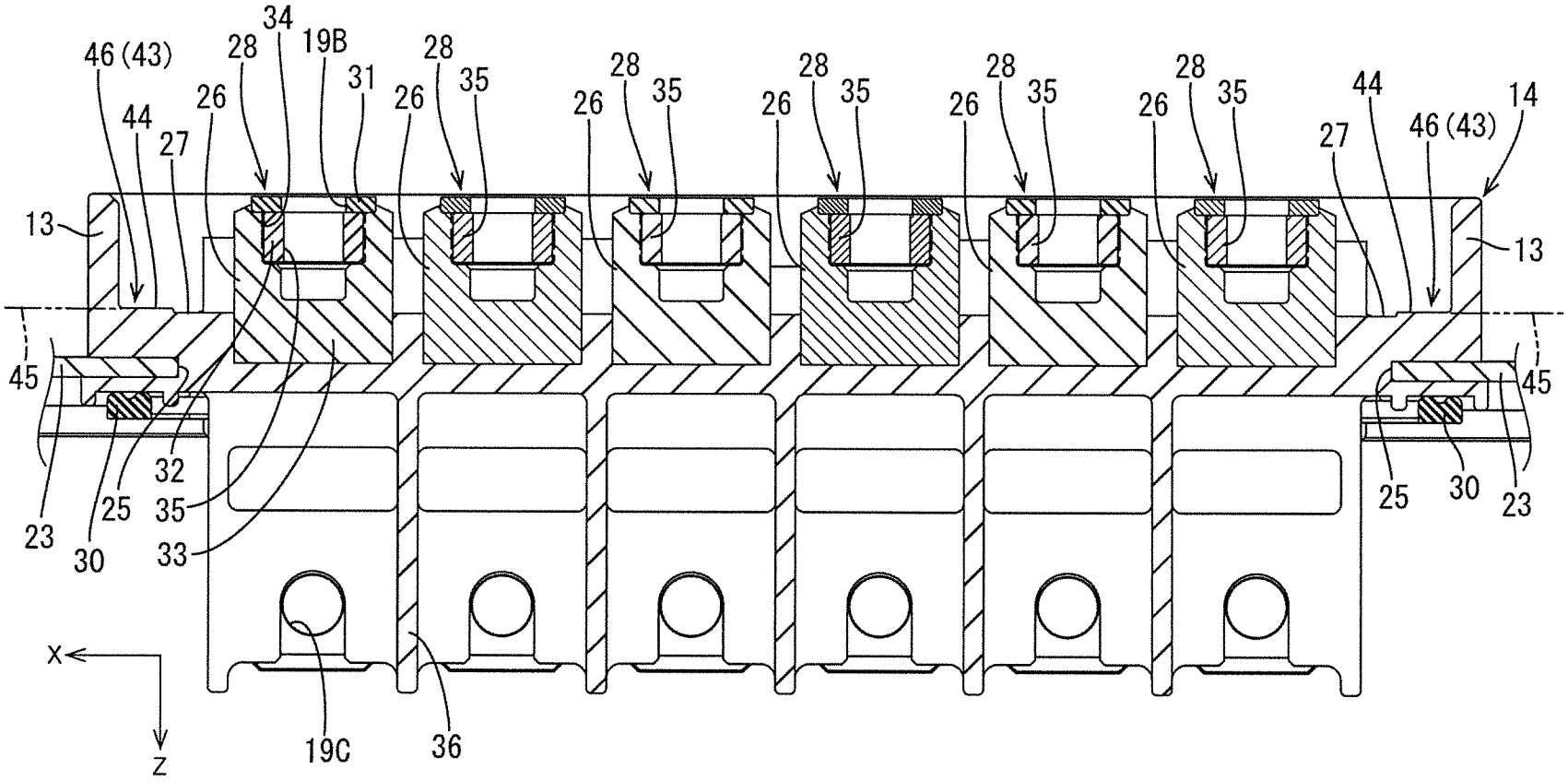
FIG. 5 is a section along V-V of FIG. 3.
Figure 6:
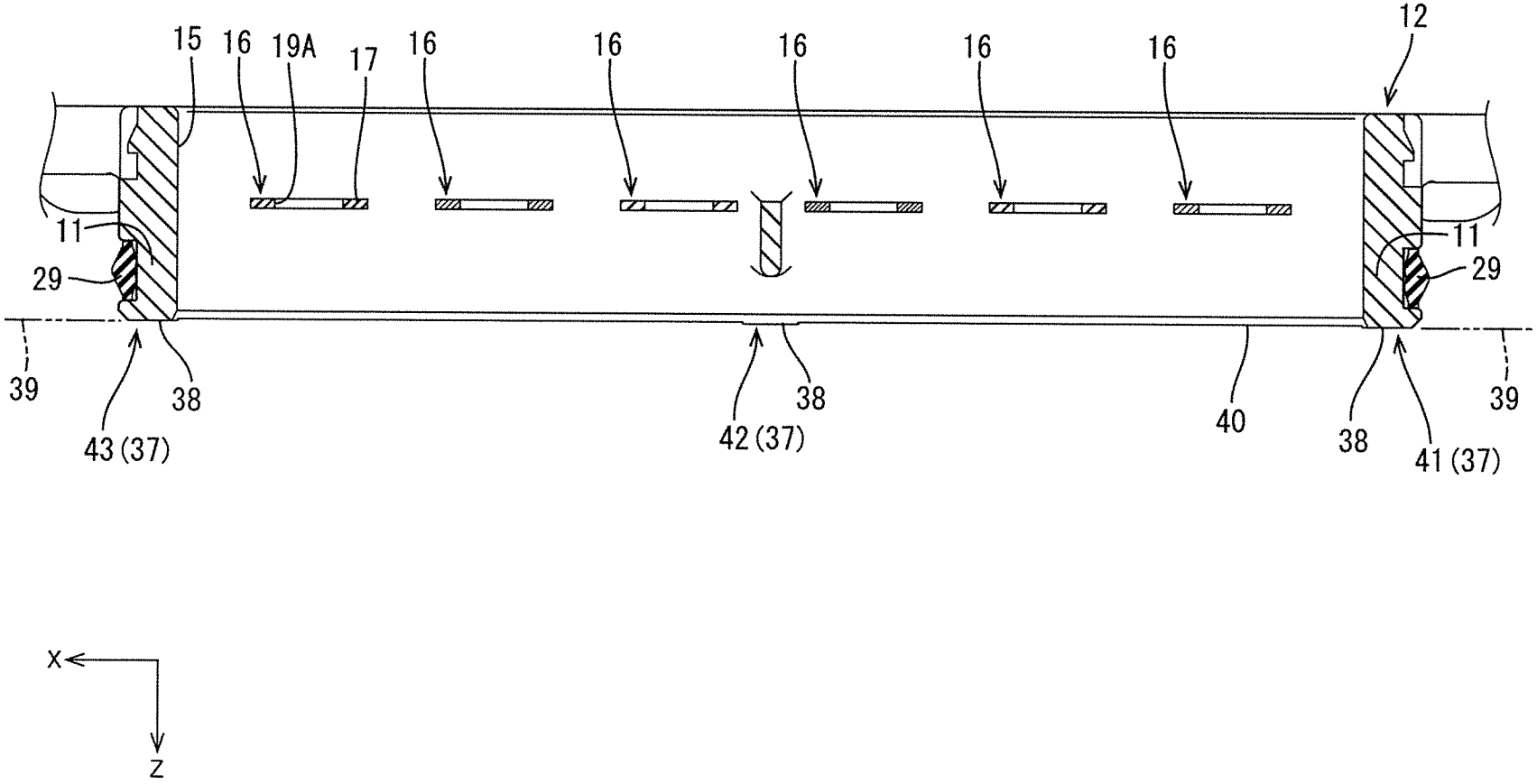
FIG. 6 is a section along VI-VI of FIG. 1.
Figure 7:
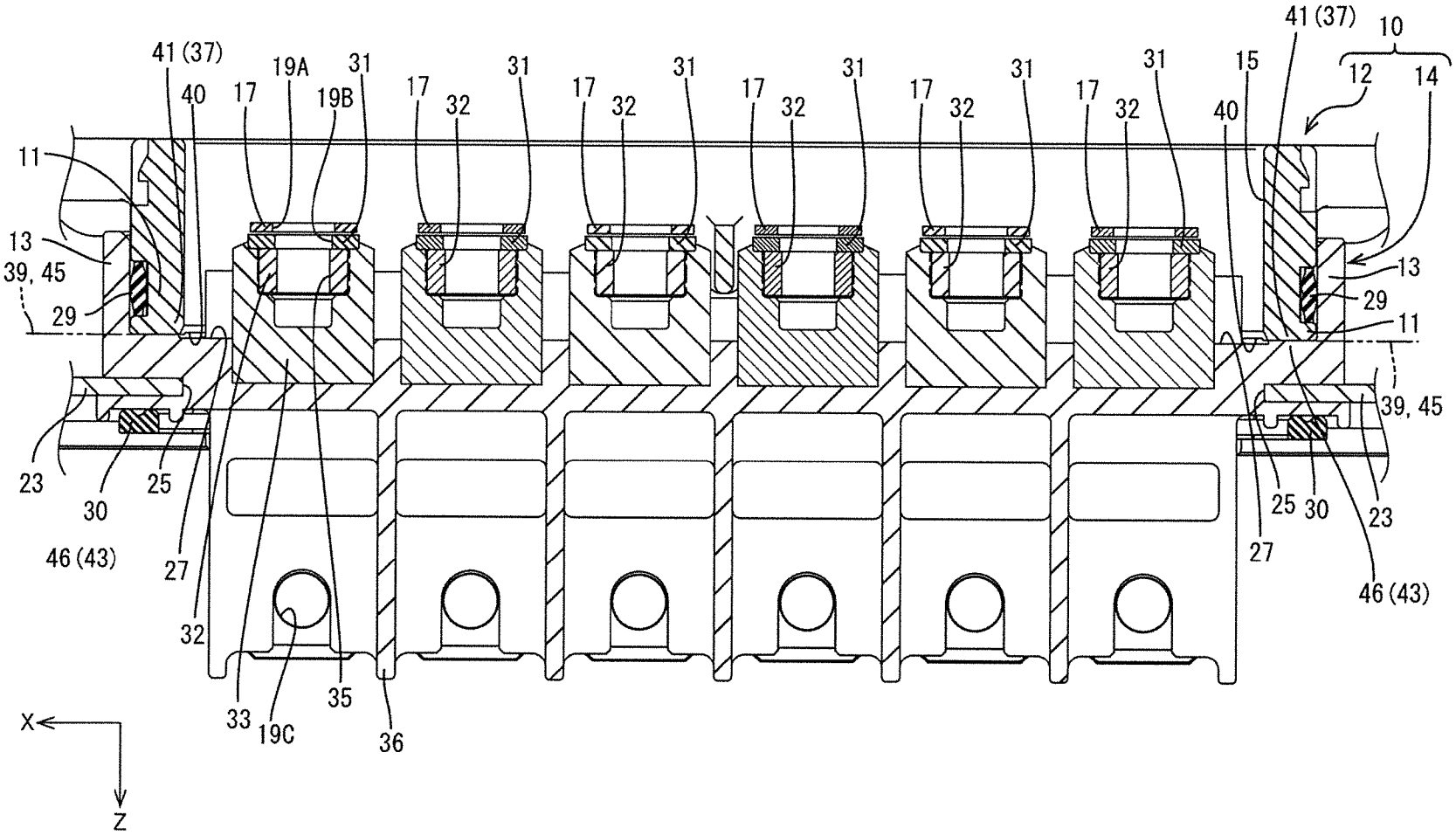
FIG. 7 is a section showing the state where the first and second housings are connected.

A seal 30 is arranged in the second housing 14 for sealing between the second housing 14 and the device in a liquid-tight manner, as shown in FIG. 5. The seal 30 is arranged between the second housing 14 and the device and closely contacts the second housing 14 and the device.

The second terminals 28 are formed by press-working a plate made of metal, such as copper, copper alloy, aluminum, aluminum alloy, iron or stainless steel. A plating layer made of metal, such as tin or nickel, is formed on a surface of the second terminal 28. As shown in FIG. 4, the second terminal 28 extends in the connecting direction and is formed into a substantially L shape when viewed in the major axis direction (direction penetrating through the plane of FIG. 4).

As shown in FIG. 5, a bolt insertion hole 19C penetrates through a front part of the second terminal 28 in the connecting direction. A bolt 18 can be inserted through the bolt insertion hole 19C and is engaged threadedly with the device so that the device and the second terminal 28 are connected electrically.

As shown in FIG. 4, a rear part of the second terminal 28 in the connecting direction is bent at a substantially right angle and defines a second connecting portion 31 to be connected to the first connecting portion 17 of the first terminal 16. As shown in FIG. 4, the first and second connecting portions 17 and 31 are fastened by the bolt 18 with the first connecting portion 17 placed on a surface opposite to the terminal block 26. A bolt insertion hole 19B penetrates through the second connecting portion 31 in the connecting direction and can receive the bolt 18.

The bolt 18 is inserted through the bolt insertion holes 19A and 19B of the first and second connecting portions 17 and 31 and is threadedly engaged with a nut 32 to fasten and electrically the first and second connecting portions 17, 31.

As shown in FIG. 4, the second terminal 28 is insert molded into synthetic resin to define an integral a primary molded part 33. The primary molded part 33 is formed with a nut holding portion 34 for holding the nut 32 at a position below the second connecting portion 31. A screw hole 35 penetrates the nut 32 in the connecting direction.

The second housing 14 includes a secondary molded part 36 integrally formed to the primary molded parts 33. More particularly, the primary molded parts 33, the nuts 32 held in the nut holding portions 34, and the plate 23 are insert molded into a synthetic resin to define an integral secondary molded part 36.

As shown in FIG. 2, the fitting 11 is formed with first projections 37 projecting forward (down in FIG. 2) in the connecting direction on a front end 40 of the fitting 11 in the connecting direction (lower end of the first housing 12 in FIG. 2).

A virtual first plane 39 is defined by tips 38 of the plurality of first projections 37. In other words, a projecting height of each first projection 37 from the front end part 40 of the fitting 11 in the connecting direction is set to define the first plane 39.

As shown in FIG. 1, the first projections 37 include two first major axis side projections 41 formed at positions of the front end 40 of the fitting 11 in the connecting direction near opposite ends in the major axis direction (lateral direction in FIG. 1). Further, the first projections 37 include two first minor axis side projections 42 formed at positions of the front end 40 of the fitting 11 in the connecting direction near opposite end parts in the minor axis direction (vertical direction in FIG. 1). The first major axis side projections 41 and the first minor axis side projections 42 are substantially in the form of rectangular columns.

As shown in FIG. 2, second projections 43 project toward the first projections 37 from positions on the back wall 27 of the receptacle 13 corresponding to the first projections 37 when the fitting 11 is fit in the receptacle 13.

A virtual second plane 45 is defined by tips 44 of the second projections 43. In other words, a projecting height of each second projection 43 from the back wall 27 of the receptacle 13 in the connecting direction is set to define the second plane 45.

As shown in FIG. 3, the second projections 43 include two second major axis side projections 46 formed at positions of the back wall 27 of the receptacle 13 near opposite ends in the major axis direction (lateral direction in FIG. 3). The second major axis side projections 46 have a substantially arch shape. Further, the second projections 43 include two second minor axis side projections 47 formed at positions of the back wall 27 of the receptacle 13 near opposite ends in the minor axis direction (vertical direction in FIG. 3). The second minor axis side projections 47 are substantially in the form of rectangular columns.

The fitting 11 can be fit into the receptacle 13 so that the tips 38 of the first projections 37 contact the tips 44 of the second projections 43 from behind (above in FIG. 4) in the connecting direction when the first and second housings 12, 14 are connected properly. In this way, the fitting depth of the first and second housings 12, 14 is specified. At this time, the first plane 39 defined by the tips 38 of the first projections 37 and the second plane 45 defined by the tip parts 44 of the second projections 43 are aligned (see FIGS. 4 and 7).

The fitting depth of the first and second housings 12, 14 is specified so that the first and second connecting portions 17, 31 are separated slightly when the first and second housings 12, 14 are connected properly.

A spacing between the first and second connecting portions 17, 31 is set so that the first and second connecting portions 17, 31 contact each other due to deflection and deformation of both or either one of the first and second connecting portions 17, 31 when the first and second connecting portions 17, 31 are fastened by the bolt 18.

According to this embodiment, the fitting depth of the first and second housings 12, 14 is specified by the contact of the tips 38 of the first housing 12 and the tips 44 of the second projections 43 when the first and second housings 12, 14 are connected properly. Thus, the fitting depth of the first and second housings 12, 14 can be managed by managing the shapes of the tips 38 of the first projections 37 and the tips 44 of the second projections 43. The area of the tips 38 of the first projections 37 is smaller than that of the front end part 40 of the fitting 11. Thus, the shape of the first projections 37 can be managed easily. Similarly, the area of the tips 44 of the second projections 43 is smaller than that of the back wall 27 of the receptacle 13. Thus, the shape of the second projections 43 can be managed easily. As a result, the fitting depth of the first and second housings 12, 14 can be managed easily.

The receptacle 13 is long and narrow in the major axis direction perpendicular to the connecting direction. When the receptacle 13 is shaped to be long and narrow in the major axis direction as in this embodiment, the fitting 11 is also long and narrow in the major axis direction. When the receptacle 13 and the fitting 11 are long and narrow in the major axis direction as just described, it is more difficult to suppress distortion or deflection for the shapes of the back wall 27 of the receptacle 13 and the front end part 40 of the fitting 11. A technique disclosed in this description is particularly effective in easily managing the fitting depth of the first and second housings 12, 14 in the connector 10 including the receptacle 13 and the fitting 11 shaped to be long and narrow in the major axis direction.

The first projections 37 include the first major axis side projections 41 at the front end 40 of the fitting 11 near the opposite ends in the major axis direction and the second projections 43 include the second major axis side projections 46 formed at positions of the back wall 27 of the receptacle 13 near the opposite ends in the major axis direction. In this way, the first and second major axis side projections 41, 46 are formed at positions having a largest width in the major axis direction. The opposite end parts having a largest width are assumed to have a largest tolerance. The fitting depth of the first and second housings 12, 14 can be managed accurately by forming the first and second major axis side projections 41, 46 on these end parts having a largest width.

The first projections 37 include the first minor axis side projections 42 at the the front end 40 of the fitting portion 11 near the opposite end parts in the minor axis direction perpendicular to both the connecting direction and the major axis direction, and the second projections 43 include the second minor axis side projections 47 at the positions of the back wall 27 of the receptacle 13 near the opposite end parts in both the minor axis direction perpendicular to the connecting direction and the major axis direction. In this way, the fitting depth of the first and second housings 12, 14 also managed can be accurately in the minor axis direction. As a result, the fitting depth of the first and second housings 12, 14 can be managed more accurately.

Three or more first projections 37 and three or more second projections 43 are formed. Thus, the virtual first plane 39 is defined by the tips 38 of the three or more first projections 37. Further, the virtual second plane 45 is defined by the tips 44 of the three or more second projections 43 formed in this way. The fitting depth of the first and second housings 12, 14 can be managed precisely by managing the shapes of the tips 38 of the first projections 37 and the tips 44 of the second projections 43 so that the first and second planes 39, 45 are aligned.

The first housing 12 is provided with the first terminals 16 including the plate-like first connecting portion 17 and the second housing 14 is provided with the second terminals including the plate-like second connecting portion 31. The first terminals 16 and the second terminals are connected electrically by penetrating the bolts 18 through the first and second connecting portions 17, 31 that have been placed one over. Additionally, the fitting depth of the first and second housings 12, 14 is specified so that the first and second connecting portions 17, 31 are separated slightly when the first and second housings 12, 14 are connected properly.

It may not be possible to precisely manage a fitting depth of a connector in which terminals are connected electrically by being bolt-fastened while being placed one over the other, if the terminals come into contact before the housings reach a properly connected state. Further, the terminals may be damaged by the mutual contact thereof and electrical connection reliability may be reduced when connecting the housings.

In view of the above points, in this embodiment, the first and second connecting portions 17, 31 are separated slightly when the first and second housings 12, 14 are connected properly. In this way, it is possible to manage the fitting depth of the first and second housings 12, 14 and reliably electrically connect the first terminals 16 and the second terminals. Further, since damage caused by the mutual contact of the first and second connecting portions 17, 31 at the time of connecting the first and second housings 12, 14 can be suppressed, electrical connection reliability of the first terminals 16 and the second terminals can be improved.

The invention is not limited to the above described and illustrated embodiment. For example, the following embodiments are also included in the technical scope of the present invention.

The first housing 12 is mounted on the ends of the wires 20 and the second housing 14 is mounted on the device in this embodiment, there is no limitation to this. Both the first and second housings 12, 14 may be mounted on ends of wires 20. Further, both the first and second housings 12, 14 may be mounted on devices. Further, the first housing 12 may be mounted on the device and the second housing 14 may be mounted on the ends of the wires 20.

One, two, three, five or more first projections 37 may be formed. Further, one, two, three, five or more second projections 43 may be formed.

Figure 8:
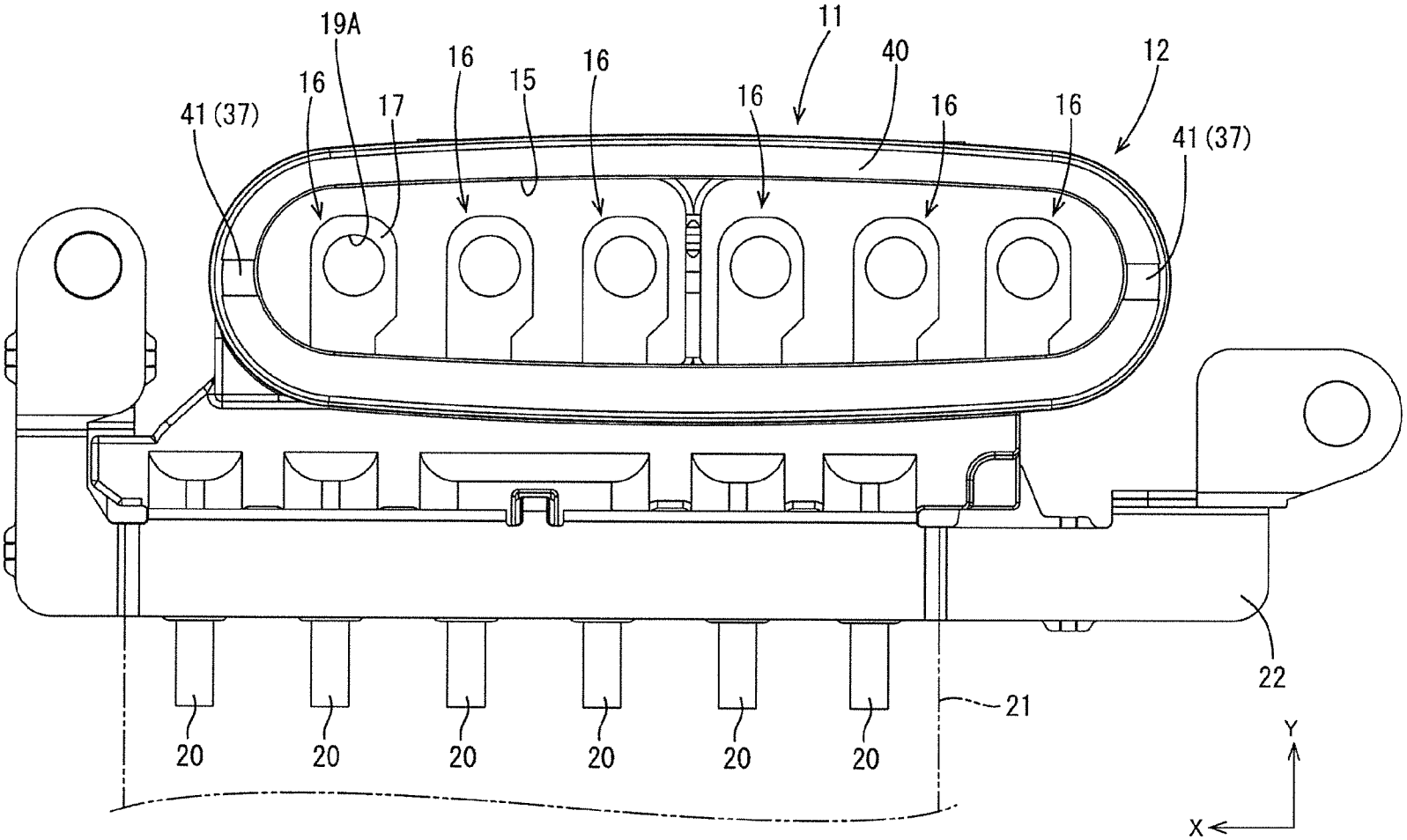
FIG. 8 is a bottom view showing a first housing according to another embodiment.
Figure 9:
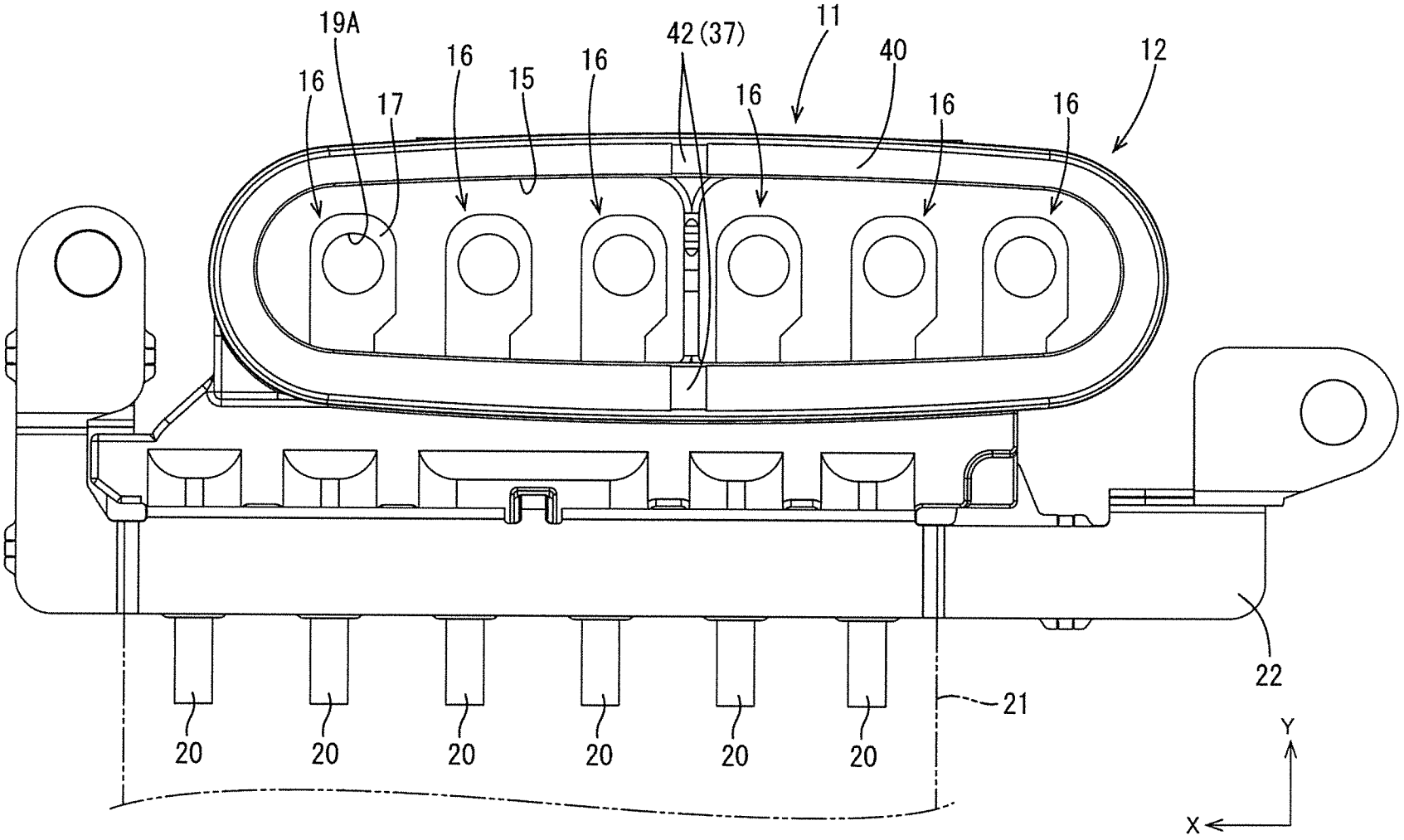
FIG. 9 is a bottom view of a first housing according to another embodiment.

The first projections 37 may include only the first major axis side projections 41 formed on the opposite end parts in the major axis direction (see FIG. 8) or only the first minor axis side projections 42 formed on the opposite end parts in the minor axis direction (see FIG. 9) and may be formed at arbitrary positions according to need. In this case, the second projections 43 are formed at positions of the second housing 14 corresponding to the first projections 37 in the state where the first and second housings 12, 14 are properly connected.

The receptacle 13 may have no major axis and no minor axis such as a circular shape, a square shape or a regular polygonal shape when viewed in the connecting direction. Similarly, the front end part 40 of the first housing 12 may be a shape having no major axis and no minor axis such as a circular shape, a square shape or a regular polygonal shape when viewed in the connecting direction.

The first and second projections 37, 43 may have cylindrical shapes, elliptical column shapes, oval column shapes or polygonal column shapes or conical shapes or polygonal pyramid shapes and other shapes according to need.

Either the first terminals 16 or the second terminals 28 may be male terminals including a male tab and the others may be female terminals including a connecting tube portion into which the male tab is to be inserted.

The connector 10 of this embodiment is a waterproof connector in which the receptacle 13 and the fitting 11 are sealed in a liquid-tight manner by the close contact of the seal ring 29 externally fitted on the receptacle 13 with the fitting 11, there is no limitation to this and the seal ring 29 may be omitted.

LIST OF REFERENCE SIGNS

10: connector
11: fitting portion
12: first housing
13: receptacle
14: second housing
16: first terminal
17: first connecting portion
18: bolt
27: back wall
28: second terminal
31: second connecting portion
37: first projection
40: front end part
41: first major axis side projection
42: first minor axis side projection
43: second projection
46: second major axis side projection
47: second minor axis side projection
X: major axis direction
Y: minor axis direction
Z: connecting direction

What is claimed is:

1. A connector, comprising:

a first housing made of synthetic resin and including a fitting with a front surface; and a second housing made of synthetic resin and including a back wall with a front surface, a tubular receptacle projecting forward from the back wall and into which the front end of the fitting is to be fit along a connecting direction, wherein:

the front surface of the fitting and the front surface of the back wall are substantially normal to the fitting direction and face one another when the fitting is fit into the receptacle;

spaced apart first projections projecting forward from the front surface of the fitting in the connecting direction and spaced apart second projections projecting forward from the front surface of the back wall of the second housing at positions aligned respectively with the first projections; and a fitting depth of the first housing into the second housings is specified by contact of tips of the first projections and tips of the second projections when the first and second housings are connected properly.

2. The connector of claim 1, wherein three or more first projections and three or more second projections are formed.

3. The connector of claim 1, wherein the receptacle is long and narrow in a major axis direction perpendicular to the connecting direction.

4. The connector of claim 3, wherein:

the first projections include first major axis side projections formed at positions of the front part of the fitting near opposite end parts in the major axis direction; and the second projections include second major axis side projections formed at positions of the back wall of the receptacle near opposite end parts in the major axis direction.

5. The connector of claim 4, wherein:

the first projections include first minor axis side projections formed at positions of the front part of the fitting near opposite end parts in a minor axis direction perpendicular to both the connecting direction and the major axis direction; and the second projections include second minor axis side projections formed at positions of the back wall of the receptacle near opposite end parts in the minor axis direction perpendicular to both the connecting direction and the major axis direction.

6. A connector, comprising:

a first housing made of synthetic resin and including a fitting; and a second housing made of synthetic resin and including a tubular receptacle into which the fitting is to be fit, wherein:

at least one first projection projects forward from a front surface of the fitting in a connecting direction and at least one second projection projects toward the first projection from a part of a back wall of the receptacle corresponding to the first projection;

a fitting depth of the first and second housings is specified by contact of a tip of the first projection and a tip of the second projection when the first and second housings are connected properly;

the first housing includes a first terminal with a plate-like first connecting portion and the second housing includes a second terminal with a plate-like second connecting portion;

the first and second terminals are connected electrically by being bolt-fastened by a bolt penetrating through the first and second connecting portions in a state where the first and second connecting portions are placed one over the other; and the fitting depth of the first and second housings is specified so that the first and second connecting portions are separated slightly when the first and second housings are connected properly.

* * * * *